US008577275B2

(12) United States Patent
Yamada

(10) Patent No.: US 8,577,275 B2
(45) Date of Patent: Nov. 5, 2013

(54) IMAGE CARRIER UNIT, IMAGE-FORMING APPARATUS, AND SOLID LUBRICANT

(75) Inventor: Kosuke Yamada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 188 days.

(21) Appl. No.: 13/207,838

(22) Filed: Aug. 11, 2011

(65) Prior Publication Data

US 2012/0195660 A1 Aug. 2, 2012

(30) Foreign Application Priority Data

Feb. 1, 2011 (JP) ..... 2011-020081

(51) Int. Cl.
*G03G 21/00* (2006.01)

(52) U.S. Cl.
USPC ..... 399/346

(58) Field of Classification Search
USPC ..... 399/346, 324, 325
See application file for complete search history.

(56) References Cited

U.S. PATENT DOCUMENTS

| | | | | |
|---|---|---|---|---|
| 2006/0285897 | A1* | 12/2006 | Sugiura et al. | 399/346 |
| 2008/0175635 | A1 | 7/2008 | Hozumi et al. | |
| 2010/0150627 | A1 | 6/2010 | Usami | |
| 2010/0239309 | A1* | 9/2010 | Tanaka et al. | 399/346 X |
| 2011/0206430 | A1* | 8/2011 | Arai et al. | 399/346 |

* cited by examiner

*Primary Examiner* — Sophia S Chen
(74) *Attorney, Agent, or Firm* — Sughrue Mion, PLLC

(57) ABSTRACT

An image carrier unit includes an image carrier that carries a toner image developed with a developer containing a toner on a surface thereof before the toner image is transferred to a transfer member in a transfer region; a supply section that supplies a lubricant containing a fluorocarbon resin to a surface of the image carrier such that the weight fraction of the fluorocarbon resin contained in the lubricant supplied after a period of time has elapsed since a predetermined point in time is higher than the weight fraction of the fluorocarbon resin contained in the lubricant supplied at the predetermined point in time; and a removing member that is disposed in contact with the surface of the image carrier and that removes the developer remaining without being transferred to the transfer member from the surface of the image carrier.

10 Claims, 5 Drawing Sheets

IMAGE CARRIER UNIT, IMAGE-FORMING APPARATUS, AND SOLID LUBRICANT

CROSS-REFERENCE TO RELATED APPLICATIONS

This application is based on and claims priority under 35 USC 119 from Japanese Patent Application No. 2011-020081 filed Feb. 1, 2011.

BACKGROUND (i) Technical Field

The present invention relates to image carrier units, image-forming apparatuses, and solid lubricants.

(ii) Related Art

To prevent a decrease in the transfer rate of a toner image due to causes including residual developer on the surface of an image carrier, there is a technique that facilitates cleaning of the developer from the surface of the image carrier by supplying a lubricant to the image carrier.

As the toner deteriorates over time, some external additive comes off, which contributes to a decrease in the transfer rate of a toner image. To compensate for the decrease in transfer rate, a fluorocarbon resin such as polytetrafluoroethylene (PTFE) is added to the lubricant in some cases. However, the larger the amount of PTFE dispersed in the lubricant, the more quickly the surface of the image carrier wears.

SUMMARY

According to an aspect of the invention, there is provided an image carrier unit including an image carrier that rotates about an axis of rotation and that carries a toner image developed with a developer containing a toner on a surface thereof before the toner image is transferred to a transfer member in a transfer region where the image carrier is in contact with the transfer member; a supply section that supplies a lubricant containing a fluorocarbon resin to a surface of the image carrier downstream of the transfer region in a rotational direction of the image carrier such that the weight fraction of the fluorocarbon resin contained in the lubricant supplied after a period of time has elapsed since a predetermined point in time is higher than the weight fraction of the fluorocarbon resin contained in the lubricant supplied at the predetermined point in time; and a removing member that is disposed downstream of the supply section and upstream of the transfer region in the rotational direction in contact with the surface of the image carrier and that removes the developer remaining without being transferred to the transfer member from the surface of the image carrier.

BRIEF DESCRIPTION OF THE DRAWINGS

Exemplary embodiments of the present invention will be described in detail based on the following figures, wherein.

DETAILED DESCRIPTION

Exemplary Embodiments

Exemplary embodiments of the invention will now be described with reference to the drawings.

Figure 1:
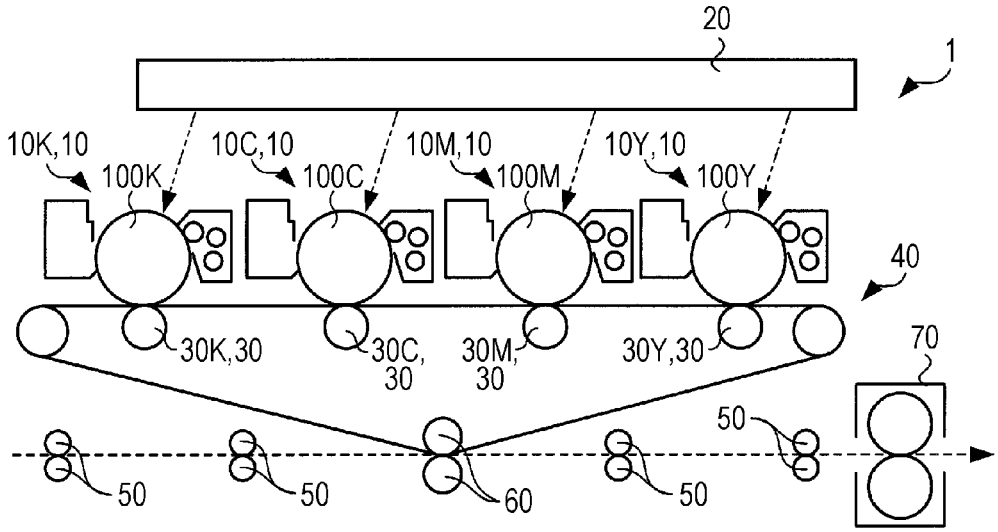
FIG. 1 is a diagram showing the structure of an image-forming apparatus according to an exemplary embodiment of the invention.

FIG. 1 is a diagram showing the structure of an image-forming apparatus 1 according to an exemplary embodiment of the invention. The image-forming apparatus 1 is an electrographic printer that forms an image on paper as a recording medium. In this exemplary embodiment, the image-forming apparatus 1 forms a color image using toners of four colors, namely, yellow (Y), magenta (M), cyan (C), and black (K). First, the overall structure of the image-forming apparatus 1 will be described.

The image-forming apparatus 1 includes photoreceptor units 10Y, 10M, 10C, and 10K, an exposure unit 20, first transfer rollers 30Y, 30M, 30C, and 30K, an intermediate transfer unit 40, transport rollers 50, a second transfer unit 60, and a fixing unit 70. The photoreceptor unit 10Y includes a photoreceptor drum 100Y, and the photoreceptor unit 10M includes a photoreceptor drum 100M. In addition, the photoreceptor unit 10C includes a photoreceptor drum 100C, and the photoreceptor unit 10K includes a photoreceptor drum 100K. The intermediate transfer unit 40 includes an intermediate transfer belt and rotating rollers, and the second transfer unit 60 includes a secondary transfer roller and a backup roller. Of the reference numerals assigned to the image-forming apparatus 1, those ending in an alphabet letter (i.e., Y, M, C, or K) denote components related to formation of images of the colors corresponding to those alphabet letters. The components denoted by the reference numerals that differ only in the alphabet letter at the end are different in position and the type of toner used, but are the same in structure. In the following description, the alphabet letters at the ends of the reference numerals will be omitted unless the components need to be distinguished.

In the image-forming apparatus 1, an image is formed on a recording medium transported in the direction indicated by the broken arrow shown in FIG. 1. The photoreceptor drums 100 are cylindrical members coated with a photoconductive film and are rotated about the axes of rotation thereof. The exposure unit 20 is a light irradiation device that irradiates (exposes) the photoconductive films on the photoreceptor drums 100 with light of controlled intensity and irradiation position. Electrostatic latent images based on the irradiation light (exposure light) are formed on the photoconductive films on the photoreceptor drums 100. The photoreceptor units 10 develop the electrostatic latent images with toners of the respective colors. Specifically, developers containing a toner and an external additive are deposited on the surfaces of the photoreceptor drums 100 to form toner images. The photoreceptor drums 100 are an example of a "photoreceptor" in exemplary embodiments of the invention. The intermediate transfer belt is an endless belt member that moves so as to rotate in contact with the rotating rollers, the first transfer rollers 30, and the backup roller. The rotating rollers are cylindrical members supporting the movement of the intermediate transfer belt and rotate about the centers thereof. The photoreceptor drums 100 are an example of an "image carrier" in exemplary embodiments of the invention, and the photoreceptor units 10 are an example of an "image carrier unit" in exemplary embodiments of the invention.

The first transfer rollers 30 are cylindrical members facing the photoreceptor drums 100 with the intermediate transfer belt therebetween and cause a potential difference in first transfer regions between the first transfer rollers 30 and the photoreceptor drums 100 to transfer toner images from the surfaces of the photoreceptor drums 100 to the surface of the intermediate transfer belt. The first transfer rollers 30 are an example of a "first transfer section" in exemplary embodiments of the invention, and the first transfer regions are an example of a "transfer region" in exemplary embodiments of the invention. In addition, the intermediate transfer belt is an example of a "transfer member" in exemplary embodiments of the invention. The second transfer roller is a cylindrical member facing the backup roller with the intermediate transfer belt therebetween and causes a potential difference at a transfer position between the second transfer roller and the backup roller to transfer a toner image from the surface of the intermediate transfer belt to the surface of a recording medium at the transfer position. The second transfer unit 60 (the second transfer roller and the backup roller) is an example of a "second transfer section" in exemplary embodiments of the invention. The transport rollers 50 are cylindrical members that transport paper to the position where the second transfer unit 60 transfers the toner image and transports the paper having the toner image to the position where the fixing unit 70 is disposed. The fixing unit 70 heats and presses the paper having the toner image to fix the toner image on the paper. The fixing unit 70 is an example of a "fixing section" in exemplary embodiments of the invention. The structure of the photoreceptor units 10 will then be described in detail.

Figure 2:
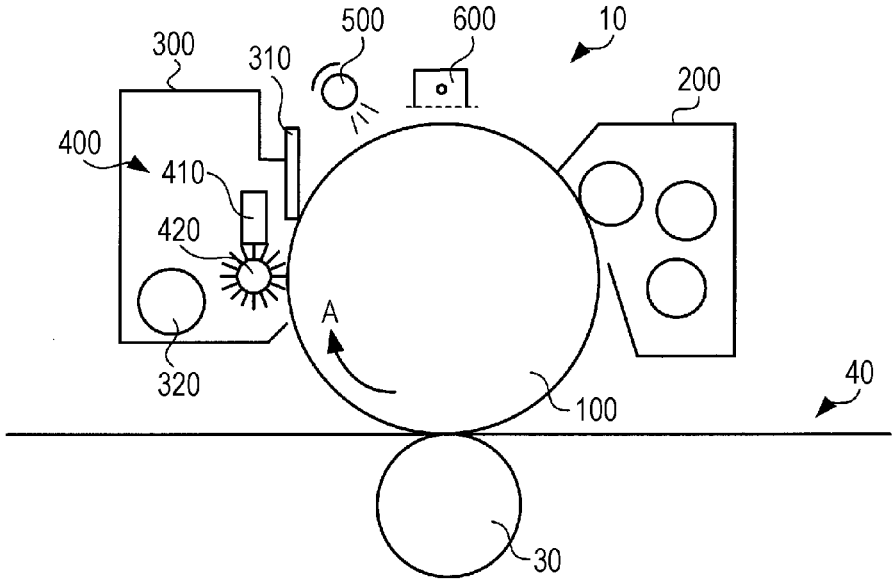
FIG. 2 is a diagram illustrating the structure of a photoreceptor unit.

FIG. 2 is a diagram illustrating the structure of the photoreceptor units 10. The photoreceptor units 10 include the photoreceptor drum 100, a developing device 200, a cleaning device 300, a static eliminator 500, and a charger 600. The static eliminator 500 is disposed around the photoreceptor drum 100 downstream of the cleaning device 300, described later, in the rotational direction of the photoreceptor drum 100 (in the arrow A direction shown in FIG. 2) to eliminate residual charge on the photoreceptor drum 100 past the first transfer regions. As used herein, the terms "upstream" and "downstream" refer to the upstream and downstream sides, respectively, in the rotational direction of the photoreceptor drum 100 unless otherwise stated.

The charger 600 is disposed downstream of the static eliminator 500 to charge the surface (photoconductive film) of the photoreceptor drum 100 to a predetermined potential after a toner image is transferred and before another toner image is formed, that is, after static elimination. The charger 600 is an example of a "charging section" in exemplary embodiments of the invention. The developing device 200 is disposed around the photoreceptor drum 100 downstream of the charger 600 and upstream of the first transfer region. The developing device 200 is a device that supplies a toner of the respective color and forms (develops) a toner image by depositing the toner on an electrostatic latent image formed on the photoreceptor drum 100 through exposure by the exposure unit 20 shown in FIG. 1. Specifically, the developing device 200 causes a potential difference between the developing device 200 and the photoreceptor drum 100 to move charged toner to the surface of the photoreceptor drum 100 by the potential difference. The toner moved to the surface of the photoreceptor drum 100 forms a toner image, which is in turn transferred to the intermediate transfer belt in contact with the photoreceptor drum 100 in the first transfer region. The first transfer region is an example of a "transfer region" in exemplary embodiments of the invention.

The cleaning device 300 is a device that removes the developer (toner and external additive) remaining without being transferred in the first transfer region. The cleaning device 300 includes a cleaning blade 310, a waste toner transporter 320, and a lubricant supply device 400. The cleaning blade 310 is disposed downstream of the first transfer region described above and upstream of the charger 600 and the static eliminator 500 and has its edge in contact with the surface of the photoreceptor drum 100 to scrape off the developer (mainly the toner). The cleaning blade 310 is an example of a "removing member" in exemplary embodiments of the invention. The waste toner transport device 320 transports the scraped foreign matter to the outside of the cleaning device 300.

The lubricant supply device 400 includes a solid lubricant 410 and a lubricant supply roller 420. The solid lubricant 410 is a block of a lubricant mainly containing a fatty acid metal salt. In this exemplary embodiment, the solid lubricant 410 mainly contains a higher fatty acid metal salt. The solid lubricant 410 is in contact with the lubricant supply roller 420. The lubricant supply roller 420 is disposed upstream of the cleaning blade 310 in the rotational direction of the photoreceptor drum 100 and rotates in contact with the surface of the photoreceptor drum 100. As the lubricant supply roller 420 rotates, it scrapes powdery lubricant off the solid lubricant 410 at the position in contact therewith, carries the powdery lubricant, and applies (supplies) it to the surface of the photoreceptor drum 100. The lubricant supply device 400, thus configured, is a device that supplies the lubricant to the surface of the photoreceptor drum 100 downstream of the first transfer region. The lubricant supply device 400 is an example of a "supply section" in exemplary embodiments of the invention.

The cleaning blade 310 may fail to completely remove residual developer (particularly, the external additive) from the surface of the photoreceptor drum 100. Such residual external additive wears the surface of the photoreceptor drum 100 as it passes through the gap between the cleaning blade 310 and the surface of the photoreceptor drum 100. In addition, the residual external additive varies the surface potential of the photoreceptor drum 100 by adhering to the charger 600 or being charged by itself. This makes it difficult to transfer the toner in the first transfer region, thus decreasing the transfer rate. If the lubricant is supplied to the surface of the photoreceptor drum 100, however, it reduces wear of the surface of the photoreceptor drum 100 and also retains the external additive, thus increasing the transfer rate of a toner image.

Next, the lubricant supply device 400 will be described in more detail with reference to FIGS. 3 and 4.

Figure 3:
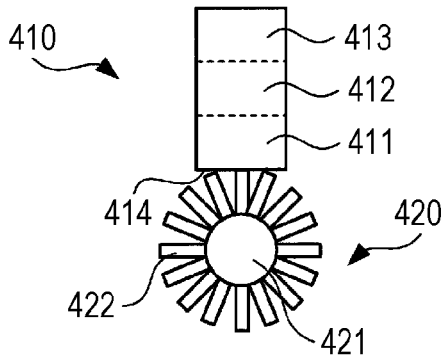
FIG. 3 is a front view of a lubricant supply device.

FIG. 3 is a front view of the lubricant supply device 400, where the term "front" refers to the direction along the axis of rotation of the lubricant supply roller 420. The solid lubricant 410 is a rectangular solid block of a lubricant containing a higher fatty acid metal salt such as zinc stearate (ZnSt) and a fluorocarbon resin such as PTFE. In this exemplary embodiment, the solid lubricant 410 is formed of a lubricant containing PTFE. The solid lubricant 410 has a surface 414 facing vertically downward as one of the surfaces of the rectangular block and includes a first layer 411, a second layer 412, and a third layer 413 stacked in order from the surface 414 to the opposite surface (surface facing vertically upward). These layers 411, 412, and 413 have different amounts of PTFE dispersed therein. In this exemplary embodiment, the amount of PTFE dispersed is expressed as the weight fraction (% by weight) of the PTFE contained. The amounts of PTFE dispersed in the first layer 411, the second layer 412, and the third layer 413 are 2% by weight, 5% by weight, and 10% by weight, respectively. In FIG. 3, the boundaries between the layers 411, 412, and 413 are indicated by the two-dot chain lines for clarity. The solid lubricant 410 is disposed such that the surface 414 is put into contact with the lubricant supply roller 420 from above in the vertical direction and is pressed against the lubricant supply roller 420 by its own weight. The first layer 411 is an example of a "first solid part" in exemplary embodiments of the invention, and the second and third layers 412 and 413 are an example of a "second solid part" in exemplary embodiments of the invention.

The lubricant supply roller 420 includes a shaft part 421 and a brush part 422. The shaft part 421 is a member that rotates about the axis of rotation and is rotatably supported inside the photoreceptor unit 10 shown in FIG. 2. The brush part 422 includes brushes extending radially from the axis of rotation. The brush part 422 is in contact with the solid lubricant 410 disposed thereabove in the vertical direction. As the shaft part 421 of the lubricant supply roller 420 rotates, the brush part 422 scrapes some lubricant off the solid lubricant 410 and carries the lubricant. The lubricant supply roller 420 transports and supplies the lubricant to the surface of the photoreceptor drum 100.

Figure 4:
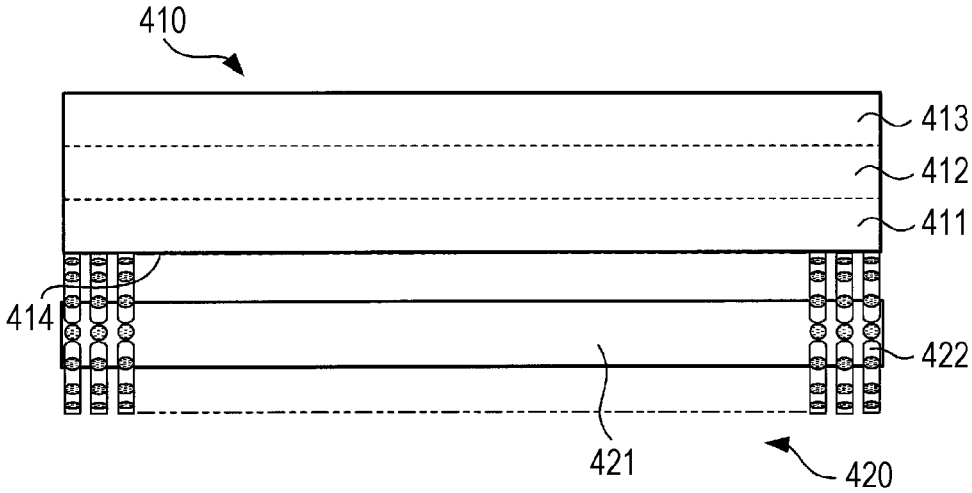
FIG. 4 is a side view of the lubricant supply device.

FIG. 4 is a side view of the lubricant supply device 400 shown in FIG. 3. The lubricant supply roller 420 has the brush part 422 over the entire length in the direction along the axis of rotation. In FIG. 4, of the blushes of the brush part 422, those near both ends in the direction along the axis of rotation are shown, and the region where the other brushes are disposed is indicated by the two-dot chain line. The solid lubricant 410 and the lubricant supply roller 420 have the same length in the direction along the axis of rotation of the lubricant supply roller 420. Thus, the solid lubricant 410 is scraped from the surface 414 side over the entire length in the direction along the axis of rotation. The length (thickness) of the solid lubricant 410 in the vertical direction becomes gradually shorter (thinner) as the lubricant supply roller 420 rotates.

Next, the effect of the amount of PTFE dispersed in the lubricant on image formation and the photoreceptor drum 100 will be described with reference to FIGS. 5, 6, and 7.

Figure 5:
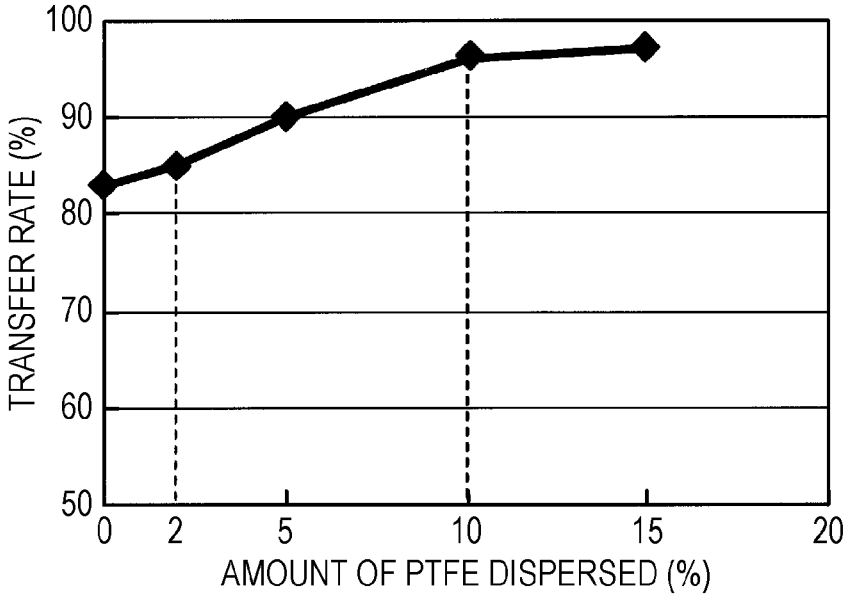
FIG. 5 is a graph showing the relationship between the amount of PTFE dispersed and transfer rate.

FIG. 5 is a graph showing the relationship between the amount of PTFE dispersed and the transfer rate obtained by measurement. As used herein, the term "transfer rate" refers to the transfer rate of a toner image, that is, the proportion of the amount of toner particles contained in a toner image formed on the intermediate transfer belt after transfer to the amount of toner particles contained in a toner image formed on the photoreceptor drum 100 before transfer. In FIG. 5, the horizontal axis indicates the amount of PTFE dispersed (% by weight), and the vertical axis indicates the transfer rate (%). As shown in this graph, the transfer rate increases with increasing amount (weight fraction) of PTFE dispersed. That is, the amount of foreign matter removed increases with increasing amount of PTFE dispersed in the lubricant supplied. In particular, the rate at which the transfer rate increases with increasing amount of PTFE dispersed (that is, the gradient of the curve shown in the graph of FIG. 5) is higher at or below an amount of PTFE dispersed of 10% by weight than above an amount of PTFE dispersed of 10% by weight.

Figure 6:
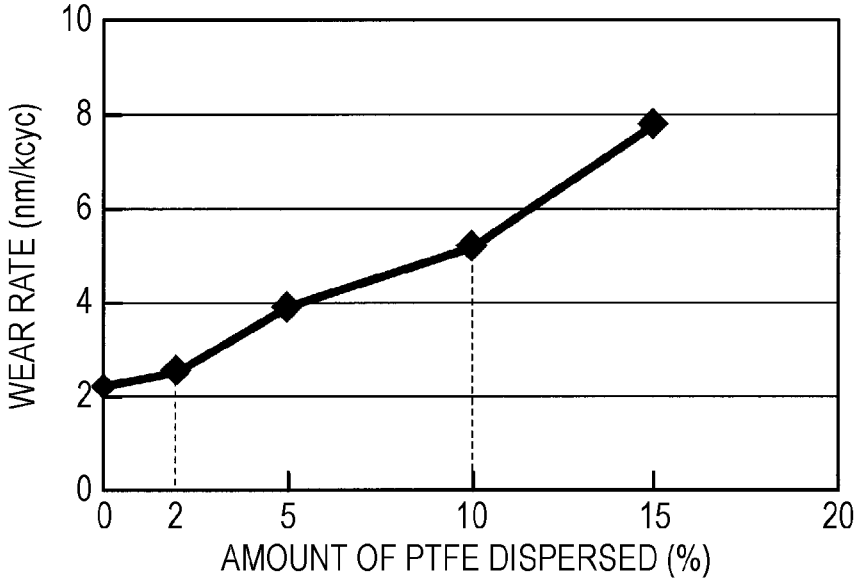
FIG. 6 is a graph showing the relationship between the amount of PTFE dispersed and the wear rate of a photoreceptor drum.

FIG. 6 is a graph showing the relationship between the amount of PTFE dispersed and the wear rate obtained by measurement. As used herein, the term "wear rate" refers to the degree of wear of the photoreceptor drum 100 supplied with the lubricant, specifically, the thickness (nm) by which the surface of the photoreceptor drum 100 wears after 1,000 turns. In the graph of FIG. 6, the horizontal axis indicates the amount of PTFE dispersed (% by weight), and the vertical axis indicates the wear rate (nm per 1,000 turns (kcyc)). The wear rate increases with increasing amount of PTFE dispersed. That is, the degree of wear of the surface of the photoreceptor drum 100 increases with increasing amount of PTFE dispersed in the lubricant supplied. In particular, the rate at which the wear rate increases (that is, the gradient of the curve shown in the graph of FIG. 6) is higher at or above an amount of PTFE dispersed of 2% by weight.

Figure 7:
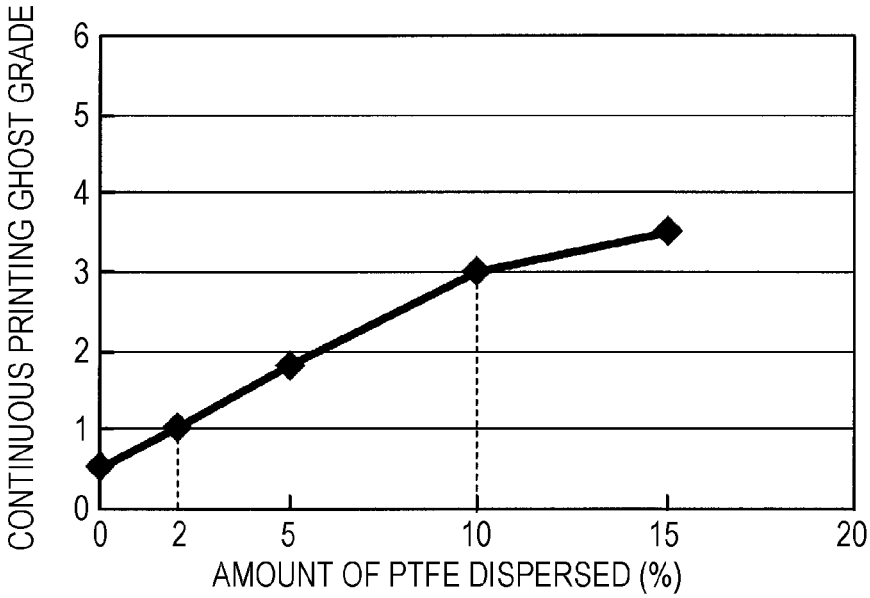
FIG. 7 is a graph showing the relationship between the amount of PTFE dispersed and continuous printing ghost grade.

FIG. 7 is a graph showing the relationship between the amount of PTFE dispersed and the continuous printing ghost grade obtained by measurement. As used herein, the term "continuous printing ghost" refers to the phenomenon in which negatively charged foreign matter (such as the toner and the external additive coming off the surfaces of the toner particles) remaining in a certain region without being removed by the cleaning blade 310 varies the surface potential of the photoreceptor drum 100, thus forming an image varying in density from the intended image in that region (causing density variations). The continuous printing ghost grade (degree of density variation) increases with increasing amount of residual foreign matter. In the graph of FIG. 7, the horizontal axis indicates the amount of PTFE dispersed (% by weight), and the vertical axis indicates the density difference between regions of the same color (for example, white) with and without continuous printing ghost (continuous printing ghost grade). A higher continuous printing'ghost grade indicates a larger density difference due to continuous printing ghost. As shown in FIG. 7, the continuous printing ghost grade increases with increasing amount of PTFE dispersed.

In the image-forming apparatus 1, as shown in FIGS. 5, 6, and 7, as the amount of PTFE dispersed in the lubricant supplied to the surface of the photoreceptor drum 100 is increased, the transfer rate of a toner image increases, although the surface wears more easily, and continuous printing ghost occurs more easily. That is, there is a trade-off between increasing the transfer rate and decreasing the wear rate of the surface of the photoreceptor drum 100 and the continuous printing ghost grade.

In general, the product life of the photoreceptor unit 10 lasts until it runs out of its developer and lubricant contained upon production. The life lasts, for example, until the photoreceptor drum 100 rotates 500,000 to 1,000,000 times. The toner contained in the developer deteriorates over time before the life ends; for example, the external additive tends to come off. A toner from which some external additive has come off is less electrically charged, and is therefore less easily transferred, than a toner covered with the external additive. That is, the transfer rate of a toner image in the photoreceptor unit 10 decreases as the toner deteriorates.

As shown in FIGS. 3 and 4, the amount of PTFE dispersed in the solid lubricant 410 is larger on the side farther away from the lubricant supply roller 420 (brush part 422) upward in the vertical direction than on the side in contact therewith. Accordingly, the amount (weight fraction) of PTFE dispersed in the lubricant supplied from the lubricant supply device 400 increases stepwise with increasing amount of lubricant that has been supplied. For example, when the supply of the lubricant is started, the lubricant supply device 400 supplies the lubricant from the first layer 411, which has 2% by weight of PTFE dispersed therein. After one third of the total amount of lubricant has been supplied, the lubricant supply device 400 supplies the lubricant from the second layer 412, which has 5% by weight of PTFE dispersed therein. After two thirds of the total amount of lubricant have been supplied, the lubricant supply device 400 supplies the lubricant from the third layer 413, which has 10% by weight of PTFE dispersed therein. Thus, for example, when the supply of the lubricant is started, the lubricant supply device 400 supplies the lubricant from the first layer 411, so that the wear rate and the continuous printing ghost grade are lower than in the case where the lubricant is supplied from the second layer 412. When the lubricant supply device 400 supplies the lubricant from the second layer 412, the transfer rate is higher than in the case where the supply of the lubricant from the first layer 411 is continued. In addition, when the supply of the lubricant from the second layer 412 is started, the wear rate and the continuous printing ghost grade are lower than in the case where the lubricant is supplied from the third layer 413. When the lubricant supply device 400 supplies the lubricant from the third layer 413, the transfer rate is higher than in the case where the supply of the lubricant from the second layer 412 is continued. In this way, the photoreceptor unit 10 adjusts stepwise the trade-off between decreasing the wear of the surface of the photoreceptor drum 100 and the continuous printing ghost grade and increasing the transfer rate decreased as the toner deteriorates over time.

In addition, as the transfer rate varies, the density of an image formed on a recording medium by the image-forming apparatus 1 varies. For example, for the same image formed by the image-forming apparatus 1, as the transfer rate decreases, the amount of toner contained in the toner image transferred to the intermediate transfer belt decreases, and accordingly the density of the image formed on the paper by the image-forming apparatus 1 decreases. On the other hand, as the transfer rate increases, the amount of toner contained in the toner image transferred to the intermediate transfer belt increases, and accordingly the density of the image formed on the paper by the image-forming apparatus 1 increases. That is, as the transfer rate decreases over time, the density of the image formed on the paper decreases, and accordingly the quality of the image varies. For the image-forming apparatus 1 having the photoreceptor units 10, in contrast, the transfer rate decreased over time increases, so that the quality of the image formed on the paper varies little.

The lubricant supply device 400 supplies the lubricant to the surface of the photoreceptor drum 100 as the photoreceptor drum 100 rotates. That is, the amount of lubricant supplied by the lubricant supply device 400 increases with increasing number of times the photoreceptor drum 100 has rotated. Therefore, in other words, the lubricant supply device 400 increases the amount of PTFE dispersed in the lubricant supplied stepwise with increasing number of times the photoreceptor drum 100 has rotated.

According to an experiment conducted by the inventor, a solid lubricant having a small amount of PTFE (for example, about 2% by weight) dispersed therein does not chip or crack easily, and a solid lubricant having a large amount of PTFE (for example, more than 10% by weight) dispersed therein chips or cracks easily. In particular, if the amount of PTFE dispersed is more than 10% by weight, the solid lubricant 410 has a noticeable tendency to chip or crack when disposed so as to be pressed against the lubricant supply roller 420 by its own weight. On the other hand, in the state shown in FIG. 4, that is, when the supply of the lubricant by the lubricant supply device 400 is started, a force equivalent to the total weight of the first layer 411, the second layer 412, and the third layer 413 acts on the first layer 411, although the solid lubricant 410 does not chip or crack easily because the first layer 411 has 2% by weight of PTFE dispersed therein.

As the supply of the lubricant is continued, as described above, the lubricant is scraped off the solid lubricant 410 by the brush part 422, and the solid lubricant 410 becomes gradually thinner.

Figure 8:
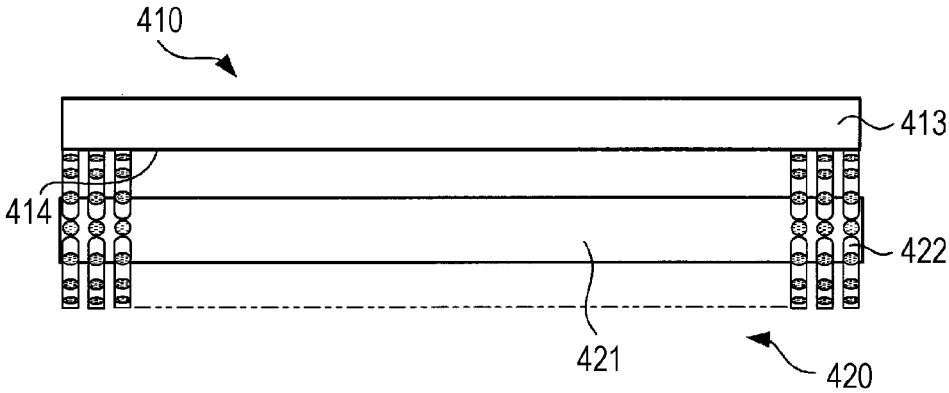
FIG. 8 is a side view of the lubricant supply device.

FIG. 8 is a side view showing the state where the solid lubricant 410 shown in FIG. 4 has become thin. In the example of FIG. 8, the first layer 411 and the second layer 412 have been scraped off the solid lubricant 410, and the surface 414 of the third layer 413 facing vertically downward is in contact with the brush part 422. The weight of the solid lubricant 410 shown in FIG. 8 is roughly one third of the weight of the solid lubricant 410 shown in FIG. 4. Accordingly, the force acting on the third layer 413 from the brush part 422 is roughly one third of the force acting on the first layer 411 in FIG. 4. The third layer 413, which has 10% by weight of PTFE dispersed therein, chips or cracks more easily than the first layer 411, although the third layer 413 chips or cracks less easily than in the case where the three layers 411, 412, and 412 remain because the force acting on the third layer 413 is roughly one third of the force acting in the state of FIG. 4. Thus, the photoreceptor unit 10 increases stepwise the transfer rate of a toner image decreased over time while making the solid lubricant 410 resistant to chipping and cracking.

MODIFICATIONS

The exemplary embodiment described above is merely illustrative of exemplary embodiments of the invention; various applications and modifications are possible, optionally in combination, as follows.

First Modification

Solid lubricants according to exemplary embodiments of the invention are not limited to solid lubricants having three layers, but include solid lubricants having two layers and solid lubricants having four or more layers. For such solid lubricants, the amount of PTFE dispersed in the lubricant supplied by the lubricant supply device after a period of time (for example, the period of time required for one layer to be used up) has elapsed since a predetermined point in time after the start of use (for example, the point in time when the supply of the lubricant is started) may be larger than the amount of PTFE dispersed in the lubricant supplied at the predetermined point in time. In other words, the amount of PTFE dispersed in the lubricant supplied by the lubricant supply device may increase after a period of time has elapsed at least once. This reduces wear of the surface of the photoreceptor drum 100 and maintains low printing ghost grade when a lubricant having a smaller amount of PTFE dispersed is supplied, and improves the transfer rate when a lubricant having a larger amount of PTFE dispersed is supplied.

For example, if a solid lubricant having two layers is used, it may be disposed in the lubricant supply device such that the layer having a smaller amount of PTFE dispersed therein (an example of a "first solid part" in exemplary embodiments of the invention) is put into contact with the brush part 422 from above in the vertical direction. In this case, for example, the amount of PTFE dispersed in the lubricant supplied by the lubricant supply device after a period of time has elapsed since the point in time when the supply of the lubricant is started (an example of a "predetermined point in time" in exemplary embodiments of the invention), and accordingly one layer has been used up, is larger than the amount of PTFE dispersed in the lubricant supplied at the point in time when the supply of the lubricant is started. Thus, the photoreceptor unit including the solid lubricant having two layers adjusts the trade-off between decreasing the wear of the surface of the photoreceptor drum and the printing ghost grade and increasing the transfer rate decreased over time. In addition, this photoreceptor unit increases the transfer rate of a toner image decreased over time while making the solid lubricant resistant to chipping and cracking.

If a solid lubricant is used that has four or more layers having different amounts of PTFE dispersed therein and arranged such that the amount of PTFE dispersed increases (or decreases) stepwise from the layer at one end to the layer at the other end, it may be disposed in the lubricant supply device such that the layer having the smallest amount of PTFE dispersed therein is put into contact with the brush part 422 from above in the vertical direction.

Second Modification

Solid lubricants according to exemplary embodiments of the invention are not limited to layered solid lubricants, but include solid lubricants configured such that the amount of PTFE dispersed changes gradually (continuously) as more lubricant is supplied to the photoreceptor drum 100. For example, the amount of PTFE dispersed may increase gradually vertically upward from the side in contact with the brush part 422.

Figure 9:
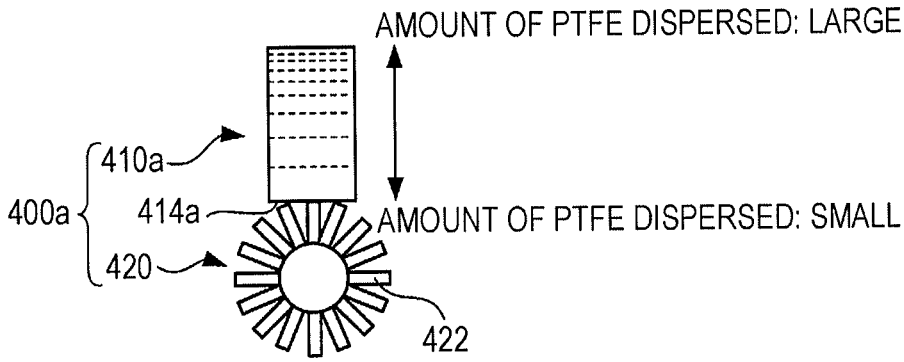
FIG. 9 is a front view of a lubricant supply device according to a modification of the exemplary embodiment of the invention.

FIG. 9 is a front view of a lubricant supply device 400*a* including a solid lubricant 410*a* according to this modification. The amount of PTFE dispersed in the solid lubricant 410*a* increases gradually vertically upward from a surface 414*a* in contact with the brush part 422. In FIG. 9, the amount of PTFE dispersed is indicated by the widths between the two-dot chain lines; a smaller width indicates a larger amount of PTFE dispersed. In this case, the lubricant supply device 400*a* gradually increases the amount of PTFE dispersed in the lubricant supplied to the surface of the photoreceptor drum 100 as the amount of lubricant that has been supplied increases (or as the number of times the photoreceptor drum 100 has rotated increases). That is, the lubricant supply device 400*a* increases the amount of PTFE dispersed as the toner deteriorates. Thus, the photoreceptor unit having the lubricant supply device 400*a* gradually adjusts the trade-off between decreasing the wear of the surface of the photoreceptor drum and the printing ghost grade and increasing the transfer rate decreased over time. In addition, this photoreceptor unit gradually increases the transfer rate of a toner image decreased over time while making the solid lubricant 410*a* resistant to chipping and cracking. The lubricant supply device 400*a* is an example of a "supply section" in exemplary embodiments of the invention.

Third Modification

Solid lubricants according to exemplary embodiments of the invention are not limited to rectangular solid lubricants, but include solid lubricants of other shapes. Such a solid lubricant may be disposed so as to be put into contact with the lubricant supply roller 420 (brush part 422) from above in the vertical direction and be pressed against the lubricant supply roller 420 by its own weight. In addition, the amount of PTFE dispersed may be larger on the side farther away from the lubricant supply roller 420 upward in the vertical direction than on the side in contact therewith, or may increase gradually farther away from the side in contact with the brush part 422.

Fourth Modification

Lubricant supply devices according to exemplary embodiments of the invention are not limited to those that supply solidified lubricants, but include those that supply liquid or gel lubricants. One such example is a lubricant supply device including a section that is sequentially filled with liquid lubricants having different amounts of PTFE dispersed therein and that drops the lubricants on the brush part.

Figure 10:
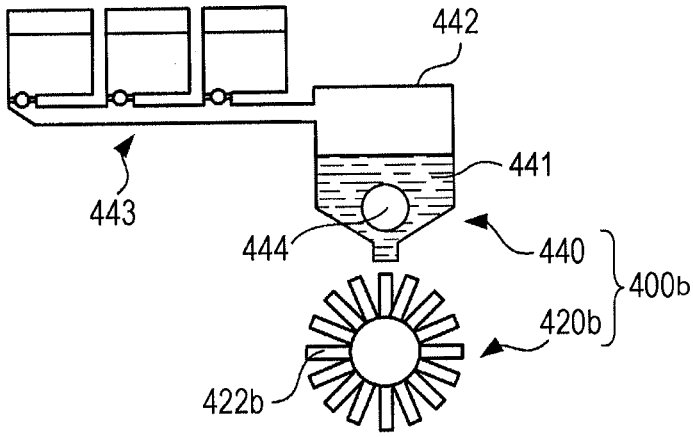
FIG. 10 is a front view of a lubricant supply device according to another modification of the exemplary embodiment of the invention.

FIG. 10 is a front view of a lubricant supply device 400*b* including a lubricant-dropping section 440 according to this modification. The lubricant-dropping section 440 includes a housing 442 containing a liquid lubricant 441, a filing part 443 that stores liquid lubricants having different amounts of PTFE dispersed therein and that sequentially fills the housing 442 therewith, and a stirring part 444 that stirs the lubricant. A lubricant supply roller 420*b* includes a brush part 422*b* including brushes capable of carrying the liquid lubricant. The lubricant-dropping section 440 drops the lubricant on the brush part 422*b*, which then carries the dropped lubricant and transports and supplies it to the surface of the photoreceptor drum 100. The housing 442 has a device (not shown) that detects the amount of lubricant stored. If the amount of lubricant 441 stored in the housing 442 falls below a predetermined level, the lubricant-dropping section 440 fills the housing 442 with the lubricant stored in the filing part 443 and stirs the lubricant stored in the housing 442 with the stirring part 444. The lubricant-dropping section 440 drops the lubricants to the brush part 422*b* in ascending order of the amount of PTFE dispersed. Thus, the lubricant supply device 400*b* increases the amount of PTFE dispersed in the lubricant supplied to the surface of the photoreceptor drum 100 as the amount of lubricant that has been supplied increases. The lubricant supply device 400*b* is an example of a "supply section" in exemplary embodiments of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image carrier unit comprising:

an image carrier that rotates about an axis of rotation and that carries a toner image developed with a developer containing a toner on a surface thereof before the toner image is transferred to a transfer member in a transfer region where the image carrier is in contact with the transfer member;

a supply section that supplies a lubricant containing a fluorocarbon resin to a surface of the image carrier downstream of the transfer region in a rotational direction of the image carrier such that the weight fraction of the fluorocarbon resin contained in the lubricant supplied after a period of time has elapsed since a predetermined point in time is higher than the weight fraction of the fluorocarbon resin contained in the lubricant supplied at the predetermined point in time; and a removing member that is disposed downstream of the supply section and upstream of the transfer region in the rotational direction in contact with the surface of the image carrier and that removes the developer remaining without being transferred to the transfer member from the surface of the image carrier.

2. The image carrier unit according to claim 1, wherein the supply section increases stepwise or gradually the weight fraction of the fluorocarbon resin contained in the lubricant supplied to the surface of the image carrier as the toner deteriorates.

3. The image carrier unit according to claim 1, wherein the supply section increases stepwise or gradually the weight fraction of the fluorocarbon resin contained in the lubricant supplied to the surface of the image carrier as the number of times the image carrier has rotated increases.

4. The image carrier unit according to claim 1, wherein the supply section includes a rotating member that is disposed in contact with the lubricant and the image carrier and that carries and transports the lubricant to the image carrier; and the lubricant is a solid disposed so as to be put into contact with the rotating member from above in a vertical direction and be pressed against the rotating member by an own weight thereof.

5. The image carrier unit according to claim 4, wherein the lubricant includes a plurality of layers that differ in the weight fraction, the layers being stacked such that the weight fraction increases farther away from a side of the lubricant in contact with the rotating member upward in the vertical direction.

6. The image carrier unit according to claim 4, wherein the weight fraction increases gradually farther away from a side of the lubricant in contact with the rotating member upward in the vertical direction.

7. The image carrier unit according to claim 4, wherein the weight fraction is about 2% to 10% by weight.

8. The image carrier unit according to claim 1, further comprising:

a charging section that is disposed downstream of the removing member in the rotational direction and that charges the surface of the image carrier; and a forming section that is disposed downstream of the charging section and upstream of the transfer region in the rotational direction and that forms the toner image by depositing the developer on the image carrier.

9. An image-forming apparatus comprising:

the image carrier unit according to claim 1;

a first transfer section that transfers a toner image formed on the image carrier to the transfer member;

a second transfer section that transfers the toner image transferred to the transfer member by the first transfer section to a recording medium; and a fixing section that fixes the toner image transferred to the recording medium by the second transfer section.

10. A solid lubricant comprising:

a first solid part formed by solidifying a lubricant containing a fluorocarbon resin and disposed so as to be put into contact with a rotating member from above in a vertical direction and be pressed against the rotating member by an own weight thereof, the rotating member being in contact with an image carrier that carries a toner image comprising a developer containing a toner and to be transferred to a transfer member; and a second solid part formed by solidifying a lubricant containing the fluorocarbon resin and disposed above the first solid part in the vertical direction, wherein the weight fraction of the fluorocarbon resin contained in the second solid part is higher than the weight fraction of the fluorocarbon resin contained in the first solid part.

* * * * *